US010451241B2

(12) United States Patent
Japs et al.

(10) Patent No.: US 10,451,241 B2
(45) Date of Patent: Oct. 22, 2019

(54) LIGHT MODULE WITH MEANS FOR ADJUSTMENT BETWEEN A LIGHT SOURCE AND AN OPTICAL ELEMENT

(71) Applicant: Hella KGaA Hueck & Co., Lippstadt (DE)

(72) Inventors: Eduard Japs, Herford (DE); Gerd Pawliczek, Erwitte (DE); Lars Tillmann, Lippstadt (DE)

(73) Assignee: Hella KGaA Hueck & Co., Lippstadt (DE)

( * ) Notice: Subject to any disclaimer, the term of this patent is extended or adjusted under 35 U.S.C. 154(b) by 134 days.

(21) Appl. No.: 15/699,269

(22) Filed: Sep. 8, 2017

(65) Prior Publication Data

US 2017/0370550 A1 Dec. 28, 2017

Related U.S. Application Data

(63) Continuation of application No. PCT/EP2016/054562, filed on Mar. 3, 2016.

(30) Foreign Application Priority Data

Mar. 12, 2015 (DE) ..... 10 2015 103 649

(51) Int. Cl.

| | |
|---|---|
| ***F21S 41/675*** | (2018.01) |
| ***F21S 41/19*** | (2018.01) |
| ***F21S 41/39*** | (2018.01) |
| ***F21S 41/147*** | (2018.01) |

(52) U.S. Cl.

CPC ..... *F21S 41/675* (2018.01); *F21S 41/192* (2018.01); *F21S 41/39* (2018.01); *F21S 41/147* (2018.01)

(58) Field of Classification Search

CPC ..... F21S 41/675; F21S 41/192; F21S 41/39

See application file for complete search history.

(56) References Cited

U.S. PATENT DOCUMENTS 1,279,201 A * 9/1918 Overton ..... F21S 41/164 362/213
1,896,194 A * 2/1933 Grau ..... B60Q 1/068 362/512
5,268,828 A * 12/1993 Miura ..... G09F 9/33 362/249.06

(Continued)

FOREIGN PATENT DOCUMENTS

DE 10 2012 106 313 A1 1/2014
DE 10 2012 111 312 A1 5/2014

(Continued)

*Primary Examiner* — Bryon T Gyllstrom

(74) *Attorney, Agent, or Firm* — Muncy, Geissler, Olds & Lowe, P.C.

(57) ABSTRACT

A light module for a lighting device of a vehicle, in particular for a headlamp, having a light source and an optical element which is accommodated on a support body, and wherein an adjuster is provided for adjusting the optical element to the light source in order to adjust a radiation position of the light source relative to the optical element. The adjuster has a wedge element, which is arranged movably between the support body and the optical element so that when the wedge element is shifted an adjustment of the optical element to the light source can be produced at least in a vertical direction.

13 Claims, 3 Drawing Sheets

(56) References Cited

U.S. PATENT DOCUMENTS

| | | | | |
|---|---|---|---|---|
| 6,042,249 | A * | 3/2000 | Spangenberg | G01N 15/14 362/259 |
| 9,458,976 | B2 | 10/2016 | Krenn et al. | |
| 2002/0181231 | A1* | 12/2002 | Luk | F21V 5/008 362/240 |
| 2007/0025101 | A1* | 2/2007 | Lawless | F41A 9/61 362/110 |
| 2009/0303726 | A1* | 12/2009 | Borgschulte | F21V 17/02 362/294 |
| 2015/0267888 | A1* | 9/2015 | Suwa | B62J 6/02 362/512 |

FOREIGN PATENT DOCUMENTS

| | | | |
|---|---|---|---|
| GB | 202 779 | A | 8/1923 |
| WO | WO 2014/008523 | A1 | 1/2014 |

* cited by examiner

LIGHT MODULE WITH MEANS FOR ADJUSTMENT BETWEEN A LIGHT SOURCE AND AN OPTICAL ELEMENT

This nonprovisional application is a continuation of International Application No. PCT/EP2016/054562, which was filed on Mar. 3, 2016, and which claims priority to German Patent Application No. 10 2015 103 649.5, which was filed in Germany on Mar. 12, 2015, and which are both herein incorporated by reference.

BACKGROUND OF THE INVENTION

Field of the Invention

The present invention relates to a light module for a lighting device of a vehicle, in particular for a headlamp, having a light source and an optical element which is accommodated on a support body, and wherein an adjuster for adjusting the optical element to the light source is provided in order to adjust a radiation position of the light source relative to the optical element.

Description of the Background Art

WO 2014/008523 A1, which corresponds to U.S. Pat. No. 9,458,976, describes light modules for a lighting device of a vehicle which have a light source and an optical element in the form of a reflector, and the optical element is accommodated on a support body, and wherein a device for adjusting the optical element relative to the light source is provided in order to adjust a radiation position of the light source relative to the optical element. In this case, an adjustment is possible mainly in a longitudinal direction which forms the direction in which light that can be generated with the light module is emitted. A longitudinal direction simultaneously also forms the direction of travel of the vehicle, so that the optical element can be moved back and forth accordingly. Likewise, the optical element can be pivoted about a vertical direction, for example, to adjust a left or right position. The adjuster comprises mounting brackets which are arranged between a support body for receiving the light source and the light source itself. The tilting and pivoting thereby occurs by rotating about an axis in a transverse direction and by rotating about an axis in the vertical direction, wherein a height adjustment of the optical element relative to the light source is not possible.

SUMMARY OF THE INVENTION

It is therefore an object of the invention to refine a light module with an adjuster that enables a broadened adjustment of the optical element relative to the light source.

In an exemplary embodiment, the adjuster comprises a wedge element which is arranged movably between the support body and the optical element so that, when the wedge element is shifted, an adjustment of the optical element relative to the light source can be made at least in a vertical direction.

In an exemplary embodiment, the wedge element can be arranged between the support body and the optical element, which can be shifted such that the vertical position of the optical element above the support body is changed. By means of a wedge angle of the wedge element, for example, of 5 degrees, a shift with a large displacement path, for example, in the longitudinal direction, produces only a small change in position of the optical element above the support body in the vertical direction. A fine adjustment of the vertical position of the optical element above the support body is thereby possible by pushing the wedge element further between the support body and the optical element or withdrawing it therefrom.

According to an embodiment of the light module, the wedge element has an obliquely formed wedge surface, and the support body has a likewise obliquely formed bearing surface corresponding to the wedge surface. The wedge surface thereby bears against the bearing surface and slides on it when the wedge element is shifted.

The optical element can also have a bearing surface, which is formed obliquely and corresponds to the wedge surface of the wedge. However, an adjustment of the optical element above the wedge element in a longitudinal direction would not be possible without adjusting the vertical direction.

If the wedge surface and the bearing surface are formed between the wedge element and the support body and the contact surface of the wedge element has no bevel in the direction of the optical element, the optical element on the wedge element can also be adjusted in a longitudinal direction or even in a transverse direction without changing the vertical position of the optical element above the support body.

According to an embodiment of the light module, the adjuster for adjustment also comprises a first eccentric element with an eccentric, which is provided for shifting the wedge element in relation to the support body, the first eccentric element being arranged in an operative connection with the support body and with the wedge element. The eccentric element is preferably rotatably accommodated in the support body about an axis in the vertical direction, and the eccentric of the eccentric element is seated in an eccentric seat of the wedge element, so that a shifting of the wedge element above the support body is produced when the eccentric element rotates. The eccentric element advantageously has a tool seat, for example, for a screwdriver, so that the eccentric element can be rotated in a simple manner about the axis in the vertical direction. For this purpose, the optical element has a passage through which the tool can be guided in order to rotate the first eccentric element disposed between the support body and the wedge element.

According to an embodiment of the light module, at least one guide element is formed between the support body and the wedge element, wherein at least the wedge element is guided in a longitudinal direction above the support body by means of the guide element. For example, the guide element can be designed as a cylindrical pin, and two cylindrical pins can be provided for guiding the wedge element above the support body, which pins can be shifted in longitudinal holes introduced in the wedge element. Conversely, there is also the possibility of placing the cylindrical pins on the wedge element, which pins can be shifted in longitudinal holes introduced in the support body. In this case, the cylindrical pins can be made so long that they continue to pass through the elongated holes which are introduced in a base section of the optical element, so that it is possible to guide the optical element in the longitudinal direction above the support body independently of the position of the wedge element. The optical element thereby sits with the base section on the top side of the wedge element, and if the base section is guided via the guide elements in a longitudinal direction of the light module, the optical element can also be adjusted in the longitudinal direction.

If the optical element can be shifted relative to the support body, for example, in the longitudinal direction, the adjuster for adjustment can also comprise a second eccentric element with an eccentric, which is provided for shifting the optical element in relation to the support body. The second eccentric element can be arranged in an operative connection with the support body and with the optical element. In this case, the second eccentric element passes through the wedge element without forming an interaction with the wedge element. If the second eccentric element is rotated, for example, by using a suitable tool, the eccentric of the second eccentric element can be rotated in an eccentric seat in the optical element, as a result of which the optical element is shifted above the support body. The eccentric element can be rotated with a cylindrical section in a seat in the support body about a fixed axis in the vertical direction.

The eccentric seats form oval, elliptical, or ovoid contours, and the eccentric of the eccentric element preferably forms a cam shape, so that the wedge element or the optical element is shifted above the support body in that the cam cap of the eccentric is rotated within the contour of the eccentric seat and thereby slides in it.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
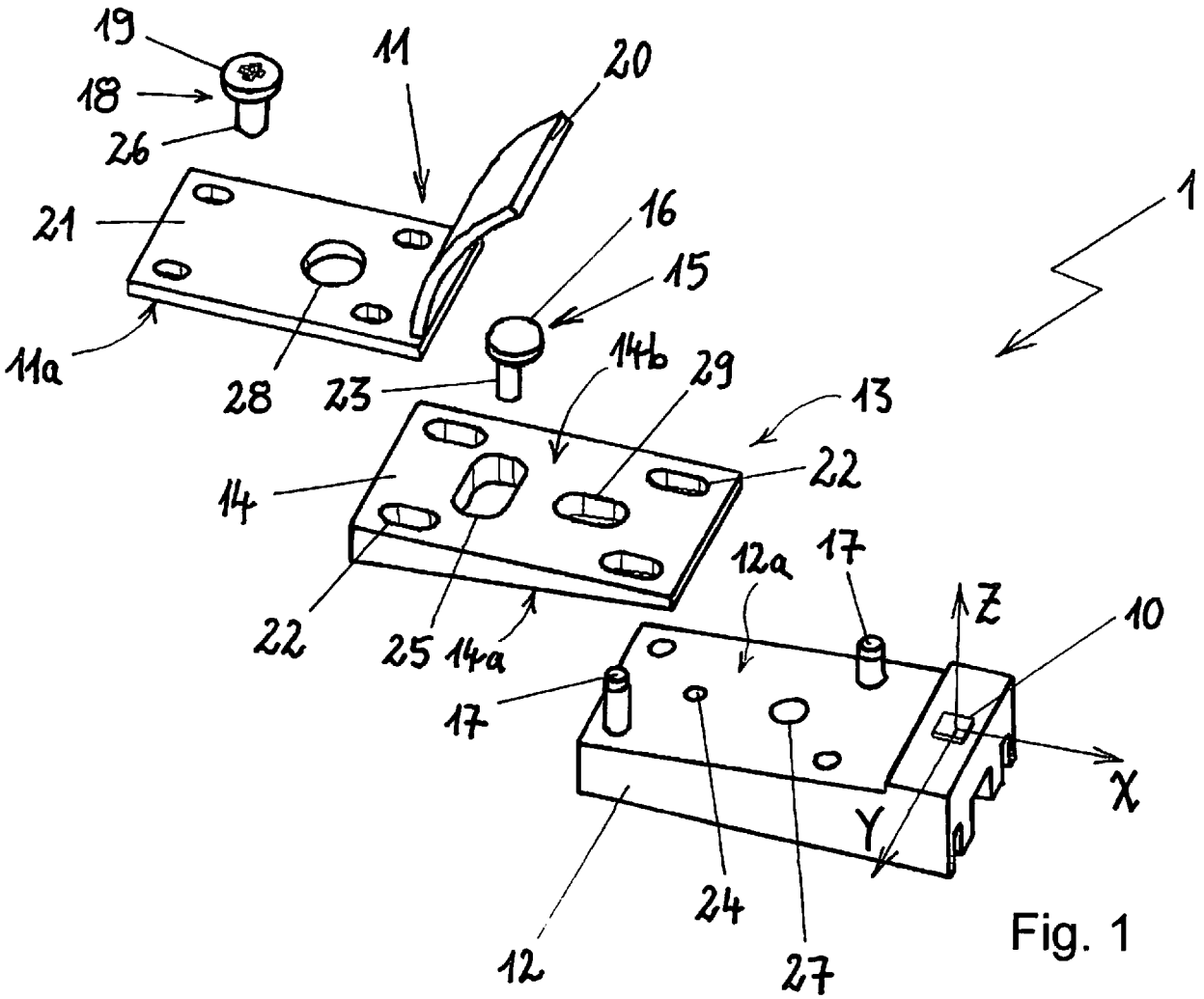
FIG. 1 shows a flying view of a light module with an optical element above a light source, a support body, and an adjuster for adjustment.

FIG. 1 shows, in a flying view, a light module 1 with a light source 10, with an optical element 11, with a support body 12, and with an adjuster 13 for adjusting optical element 11 above support body 12. A first eccentric element 15 with an eccentric 16 and a second eccentric element 18 with an eccentric 19 are also shown.

Optical element 11 has a reflector 20 and a base section 21, wherein optical element 11 can also have, for example, a lens or a lens system, a light-conducting body, or the like. The adjuster 13 described below for the adjustment of optical element 11 above support body 12 enable an adjustment in the illustrated vertical direction Z and, independently of this, an adjustment in the illustrated longitudinal direction X, wherein there remain further possibilities for an adjustment, for example, in a transverse direction Y, by the adjuster 13 for adjustment.

The adjuster 13 for adjustment comprise a wedge element 14 having a wedge surface 14*a*, which is brought into contact with a bearing surface 12*a* on support body 12. With respect to a horizontally extending longitudinal direction X, bearing surface 12*a* has an inclination corresponding to an inclination of wedge surface 14*a*. If wedge element 14 is placed on support body 12 and shifted in the longitudinal direction X, thus the height of a mounting surface 14*b* on wedge element 14 changes but without tilting, wherein mounting surface 14*b* is formed opposite to bearing surface 14*a* and points in the vertical direction Z. If optical element 11 has a base surface 11*a* of base section 21 on mounting surface 14*b* and wedge element 14 is shifted in the longitudinal direction X, the height position of optical element 11 above support body 12 changes without tilting. Light source 10 can be accommodated on support body 12, and support body 12 can form a heat sink. As a result of the shifting of optical element 11 in the vertical direction Z, reflector 20 also shifts above light source 10 so that the shifting of reflector 20 above light source 10 can be adjusted by this shifting.

Guide elements 17 are disposed on support body 12 in the form of cylindrical pins which point with their cylinder axis in the vertical direction Z. Wedge element 14 has elongated holes 22, and guide elements 17 pass through elongated holes 22 when wedge element 14 is placed on support body 12. Due to the formation of elongated holes 22 with a longitudinal extension in the longitudinal direction X, a guidance is achieved when wedge element 14 is shifted so that wedge element 14 is moved guided on support body 12.

First eccentric element 15, which is accommodated with a cylindrical section 23 in a bore 24 in support body 12, is used to shift wedge element 14 on support body 12. Eccentric 16, however, is accommodated in an eccentric seat 25, which is introduced in wedge element 14. If first eccentric element 15 is rotated, cylindrical section 23 can rotate in bore 24 about a spatially fixed axis in the vertical direction Z, and eccentric 16 rotates in eccentric seat 25, with wedge element 14 being shifted in the longitudinal direction X. Thus, first eccentric element 15 forms an operative connection between support body 12 and wedge element 14, eccentric 16 being accommodated in eccentric seat 25 in such a way that eccentric 16 does not protrude above mounting surface 14*b* of wedge element 14.

Second eccentric element 18 with eccentric 19 also has a cylindrical section 26 with which second eccentric element 18 is inserted in a bore 27 in support body 12. Thus, second eccentric element 18 as well can be rotated in an axis in the vertical direction Z. Eccentric 19 is accommodated in an eccentric seat 28, which is introduced into base section 21 of optical element 11. If second eccentric element 18 is rotated, the cam contour of eccentric 19 travels along the inner contour of eccentric seat 28 and shifts optical element 11 in the longitudinal direction X, regardless of the position of wedge element 14. In order to avoid an interaction between second eccentric element 18 and wedge element 14, wedge element 14 has a through-opening 29 through which cylindrical section 26 of second eccentric element 18 extends without creating an interaction with wedge element 14.

Figure 2:
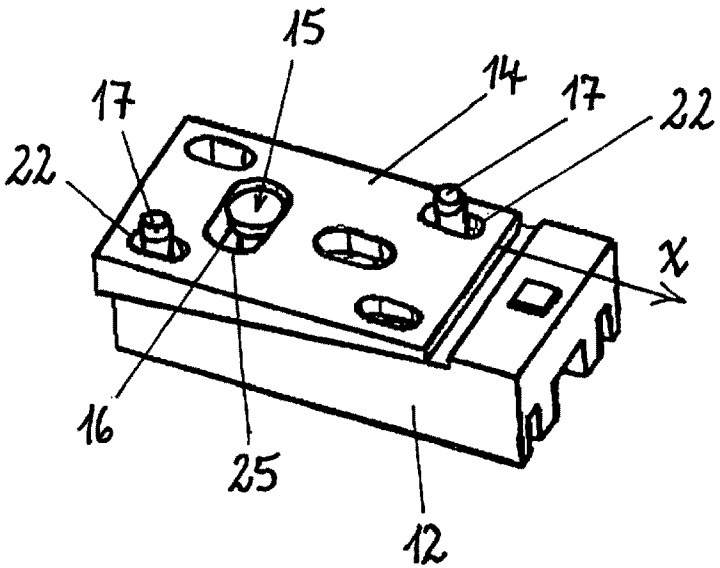
FIG. 2 shows a perspective view of a support body and a wedge element.

FIG. 2 shows a perspective view of support body 12 on which wedge element 14 is placed. The view shows the passing of guide elements 17 through elongated holes 22, wherein by way of example only guide elements 17 are located on support body 12, and elongated holes 22 are introduced in wedge element 14. Alternatively, guide elements 17 can be mounted on wedge element 14, whereas elongated holes 22 are formed on support body 12. First eccentric element 15 is shown disposed between support body 12 and wedge element 14, and it can be seen that eccentric 16 sits in eccentric seat 25.

If first eccentric element 15 is rotated, eccentric 16 moves in eccentric seat 25 so that a shifting of wedge element 14 on support body 12 is produced in the longitudinal direction X.

Figure 3:
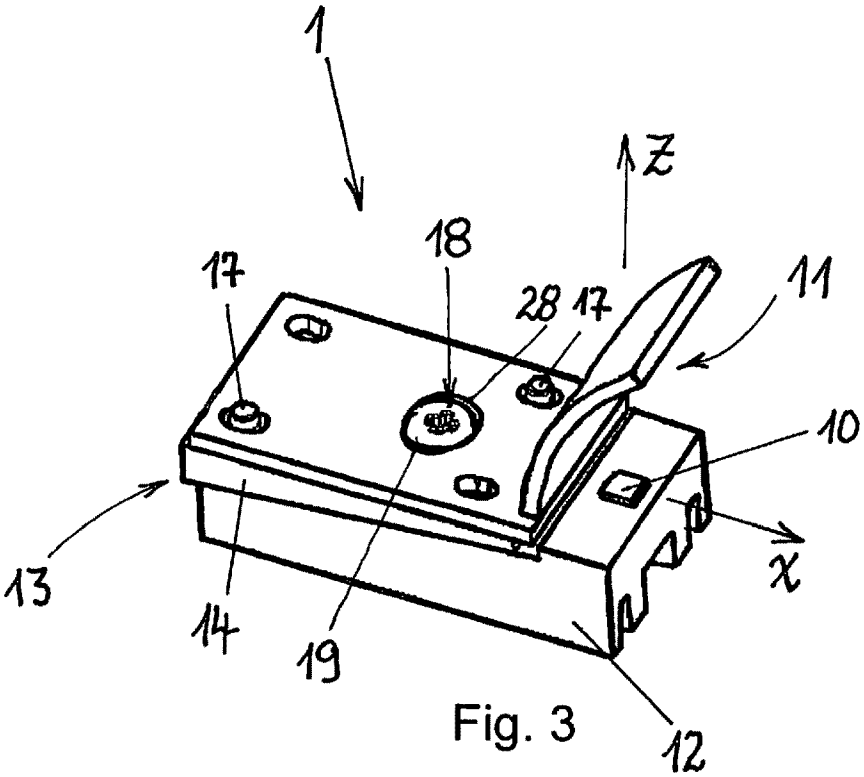
FIG. 3 shows the arrangement of the support body and the wedge element according to FIG. 2, wherein an optical element is additionally shown.

FIG. 3 shows the further arrangement of optical element 11 on wedge element 14 and second eccentric element 18 is inserted in eccentric seat 28 in optical element 11. If second eccentric element 18 is rotated, for example, with a tool which is inserted in the indicated cross slot on the top side in second eccentric element 18, eccentric 19 travels in eccentric seat 28 and optical element 11 can be shifted in the longitudinal direction X in relation to support body 12, without wedge element 14 being shifted.

A shifting of optical element 11 in the vertical direction Z relative to light source 10 can be produced as a result with the first eccentric element (concealed), whereas second eccentric element 18 produces a shift of optical element 11 in the longitudinal direction X in relation to light source 10. Light source 10 can be accommodated on support body 12 and support body 12 can form a heat sink, for example.

Figure 4B:
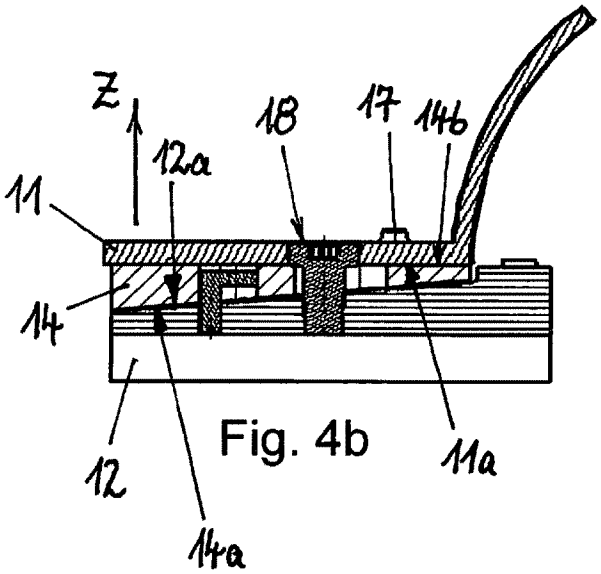
FIG. 4*b* shows a view of the light module with a wedge element which has been pushed further into the region between the optical element and the support body, as compared with the position in FIG. 4*a*.
Figure 4A:
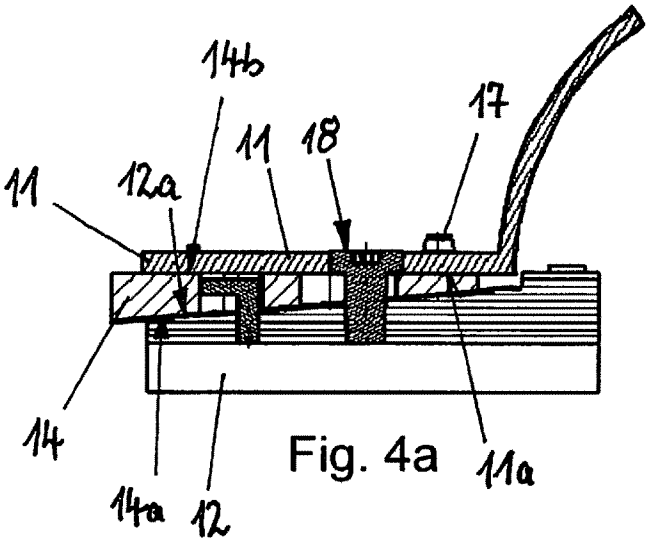
FIG. 4*a* shows a side view of the light module with a wedge element in a first position.

FIGS. 4*a* and 4*b* show a side view of support body 12, wedge element 14, and optical element 11, wedge element 14 being located between support body 12 and optical element 11. In this case, wedge surface 14*a* of wedge element 14 bears against bearing surface 12*a* of support body 12, and mounting surface 14*b* of wedge element 14 bears against base surface 11*a* of optical element 11. Shown furthermore are guide elements 17 for guiding wedge element 14 and optical element 11 in the longitudinal direction X shown.

If wedge element 14 is shifted in the longitudinal direction X, wedge element 14 can be brought from the position shown in FIG. 4*a* to the position shown in FIG. 4*b*. A shifting of optical element 11 in the vertical direction Z is produced by the inclination of bearing surface 12*a* and wedge surface 14*a*, wherein the shifting of wedge element 14 is produced by means of first eccentric element 15, as described in connection with the preceding figures.

If a shifting in the longitudinal direction X is to be produced in addition to and independently of the shifting of optical element 11 in the vertical direction Z, second eccentric element 18 can be rotated about the vertical direction Z so that optical element 11 is shifted independently of the position of wedge element 14 in longitudinal direction X. In this case, base surface 11*a* slides on mounting surface 14*b* of wedge element 14.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A light module for a lighting device of a vehicle or a headlamp, the light module comprising:

a light source;

an optical element that is accommodated on a support body; and an adjuster to adjust the optical element with respect to the light source to adjust a radiation position of the light source relative to the optical element, the adjuster comprising a wedge element that is arranged movably between the support body and the optical element so that when the wedge element is shifted, an adjustment of the optical element relative to the light source is made at least in a vertical direction, wherein the optical element is shiftable relative to the support body so that a base surface of the optical element slides over the support body.

2. The light module according to claim 1, wherein the adjuster comprises a first eccentric element with an eccentric for shifting the wedge element in relation to the support body, and wherein the first eccentric element is arranged in an operative connection with the support body and with the wedge element.

3. The light module according to claim 2, wherein the adjuster comprises a second eccentric element with an eccentric for shifting the optical element in relation to the support body, and wherein the second eccentric element is arranged in an operative connection with the support body and with the optical element.

4. The light module according to claim 3, wherein the second eccentric element passes through the wedge element.

5. The light module according to claim 2, wherein the eccentric of the first eccentric element is attached to a pin that extends through an eccentric slot in the wedge element and extends through a bore in the support body.

6. The light module according to claim 3, wherein the eccentric of the second eccentric element is attached to a pin that extends through an eccentric slot in the optical element, extends through an opening in the wedge element and extends through a second bore in the support body.

7. The light module according to claim 1, wherein at least one guide element is formed between the support body and the wedge element, wherein at least the wedge element is guided in a longitudinal direction above the support body via the at least one guide element.

8. The light module according to claim 7, wherein the optical element is guided in a longitudinal direction above the support body and above the wedge element via the at least one guide element.

9. The light module according to claim 7, wherein the at least one guide element extends through aligned elongated holes in each of the optical element and the wedge element.

10. The light module according to claim 1, wherein the optical element is shiftable relative to the support body so that the base surface of the optical element slides over the wedge element.

11. The light module according to claim 1, wherein the base surface of the optical element bears against and slides over a mounting surface of the wedge element, and a wedge surface of the wedge element, that opposes the mounting surface, bears against and slides over a bearing surface of the support body.

12. The light module according to claim 1, wherein the optical element is shiftable independent of a movement of the wedge element.

13. A light module for a lighting device of a vehicle or a headlamp, the light module comprising:

a light source;

an optical element that is accommodated on a support body; and an adjuster to adjust the optical element with respect to the light source to adjust a radiation position of the light source relative to the optical element, the adjuster comprising a wedge element that is arranged movably between the support body and the optical element so that when the wedge element is shifted, an adjustment of the optical element relative to the light source is made at least in a vertical direction, wherein the wedge element has an obliquely formed wedge surface, and wherein the support body has an obliquely formed bearing surface corresponding to the wedge surface, and wherein the wedge surface bears against the bearing surface and slides on the bearing surface when the wedge element is shifted.

* * * * *